United States Patent [19]

Andersen et al.

[11] Patent Number: 4,717,365

[45] Date of Patent: Jan. 5, 1988

[54] TRANSFORMABLE TOY VEHICLE AND SWORD COMBINATION

[75] Inventors: Michael A. Andersen; Henry Arias, both of Chicago; Wayne A. Kuna, River Forest, all of Ill.

[73] Assignee: Marvin Glass & Associates, Chicago, Ill.

[21] Appl. No.: 2,436

[22] Filed: Jan. 12, 1987

[51] Int. Cl.[4] ..... A63H 27/01; A63H 33/30

[52] U.S. Cl. ..... 446/230; 446/473; 446/489

[58] Field of Search ..... 446/230, 231, 473, 62, 446/405, 487, 489, 232

[56] References Cited

U.S. PATENT DOCUMENTS

| | | | |
|---|---|---|---|
| 2,272,643 | 2/1942 | Peters et al. | 446/230 |
| 3,010,718 | 11/1961 | Pearson, Jr. | 446/230 X |
| 3,037,320 | 6/1962 | Powell | 446/473 |
| 3,400,486 | 9/1968 | Strauss | 446/232 |
| 4,150,508 | 4/1979 | Ogawa | 446/473 X |

*Primary Examiner*—Mickey Yu

*Attorney, Agent, or Firm*—John S. Pacocha

[57] ABSTRACT

A toy sword spaceship having a generally hollow body shell containing opposed track channels in which lateral guide rails of an elongated toy sword blade are received for sliding back and forth. Pivotally mounted wings fold out when the sword blade is slid from a retracted position to a fully extended position. Depending from the sword blade is a pivotally mounted handle which folds up and is received substantially within the body shell when the blade is retracted. To receive a toy action figure, the sword spaceship is provided with a recessed cockpit area that is covered by a pivotally mounted, transparent, canopy.

18 Claims, 8 Drawing Figures

TRANSFORMABLE TOY VEHICLE AND SWORD COMBINATION

BACKGROUND OF THE INVENTION

1. Field of the Invention

This invention relates generally to toy vehicles and more particularly to a transformable toy vehicle.

2. Background Art

Toy vehicles, including those used to simulate flight, and toy swords, have long been popular playthings. However, there remains a need for a transformable toy vehicle and toy sword combination.

SUMMARY OF THE INVENTION

The present invention is concerned with providing a toy vehicle combined with a toy sword which may be easily transformed from a toy vehicle mode to a toy sword mode and back again. In the preferred embodiment, the vehicle is a spaceship having a rearwardly projecting handle and a forwardly extendable toy sword blade. The spaceship includes a hollow body having a pair of fixed wings and a pair of pivoting wings that swing out when the sword blade is extended from the hollow body. Thus, the spaceship body and its wings form a hilt for the sword. Extension and retraction of the sword blade is controlled by a forward folding handle. Action figures may be placed within a cockpit area having a flip up canopy.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figures 1, 2, 3, 4:
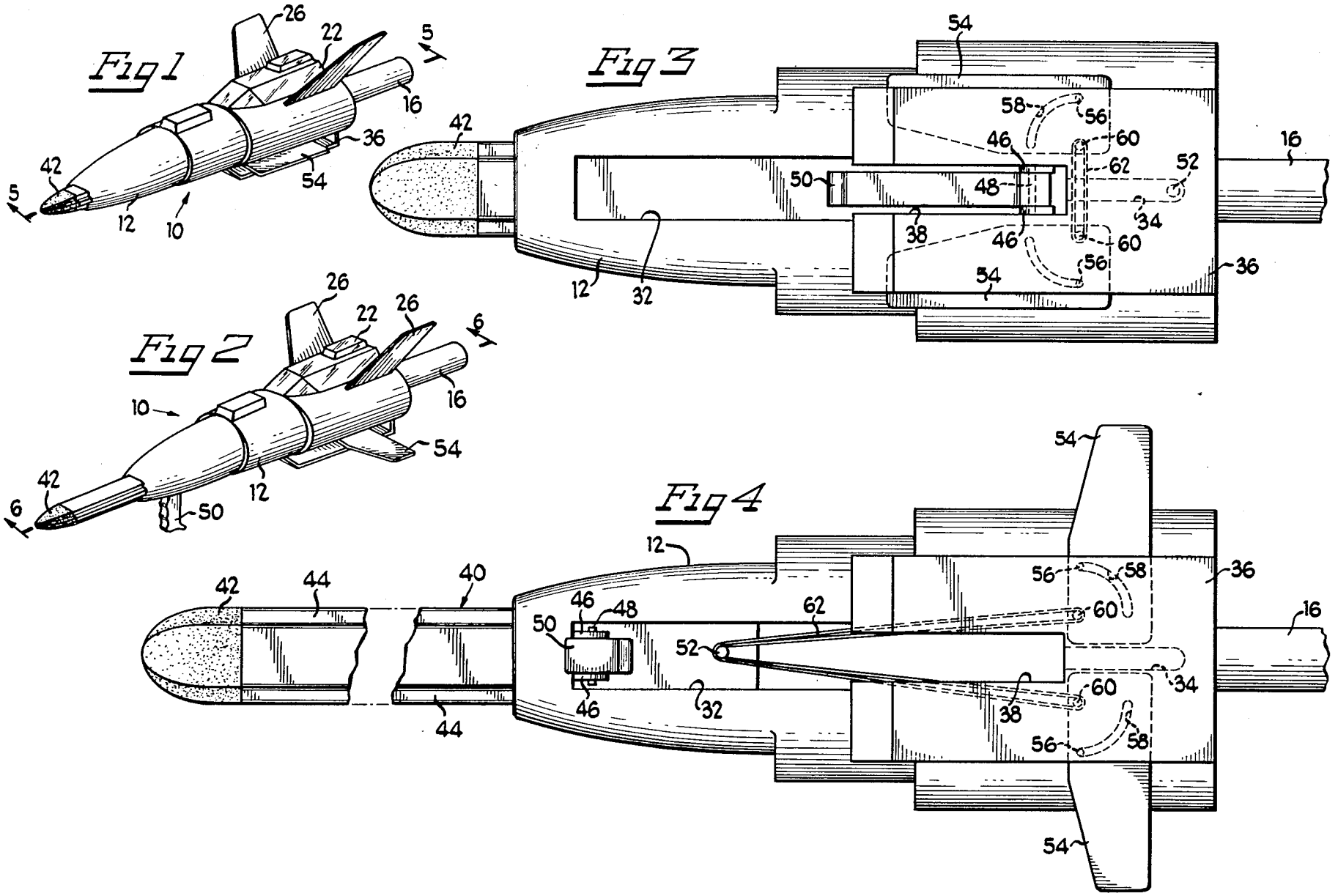
FIG. 1 is a perspective view of an embodiment of the present invention in the toy spaceship mode.
FIG. 2 is a perspective view of the embodiment in the toy sword mode.
FIG. 3 is an enlarged scale, bottom plan view of the toy spaceship mode.
FIG. 4 is an enlarged scale, bottom plan view of the toy sword mode.

Referring now to the drawings in which like parts are designated by like reference numerals throughout the several views, a toy sword spaceship 10 embodying the present invention is shown in FIGS. 1 and 2, in the toy spaceship and in the toy sword modes, respectively. Sword spaceship 10 has an elongated, substantially hollow, plastic body shell 12 with an open, truncated nose 14. The outside of hollow shell 12 is styled to simulate a spaceship. Projecting rearwardly from the back of body 10 is a generally cylindrical handle portion 16 which stylistically resembles a spaceship rocket.

Forward of handle 16, the top of body 12 is recessed to provide a cockpit area 18 into which an articulated action FIG. 20 may be placed in a seated or reclining position. Over cockpit 18, a transparent plastic canopy

22 is mounted for pivotal movement about a hinge pin 24 so that the canopy may be flipped up to provide access to the cockpit for insertion and removal of the action figure. On either side of cockpit 18, a fixed wing 26 protrudes outwardly and upwardly from body 12.

Inside of hollow body 12, there are a pair of spaced apart, integrally formed walls 28. Each wall has an upper, inwardly facing "C" shaped channel or track 30. The opposed tracks extend from near open truncated nose 14 back toward cockpit area 18. In the bottom of body shell 12, there is a central slot 32 that begins at about the forward edge of wall 28 and goes back about three quarters the length of body shell 12. Beyond slot 32, a narrower, aligned slot 34 extends further back to almost the rear of body shell 12. Depending beneath body shell 12, is a shield piece 36 attached at its back and front, but open at the sides, to form an open-sided compartment. Shield 36 may be integrally formed with body shell 12. There is a central slot 38 from the front of shield 36 back beyond the midpoint of the shield.

Slidably received in opposed tracks 30 is an elongated plastic toy sword blade 40 that preferably has a soft plastic or rubber tip 42. The sides of blade member 40 are formed with guide ribs or rails 44 that fit into tracks 30. Adjacent the rear of blade 40, about a quarter to one-fifth in from the back end, are a pair of spaced apart downwardly depending tabs 46. Mounted between tabs 46, for folding movement about a pin 48 is a handle 50. Closer to the back end of blade 40 is a downwardly depending post 52. Slot 32 accommodates handle 50 while smaller slot 34 accommodates post 52.

On either side of central slots 32, 34 and 38, a wing 54 is mounted for pivotal movement about a pin 56 that extends between the bottom of body shell 12 and the bottom of shield piece 36. Each of the wings 54 has an arcuate slot 58 that receives pin 56. Adjacent the forward inside edge of each of the wings is a peg 60. Looped around each peg 60, so as to span the gap between the two pegs in front of post 52, is an elastic band 62.

Figures 5, 6, 7, 8:
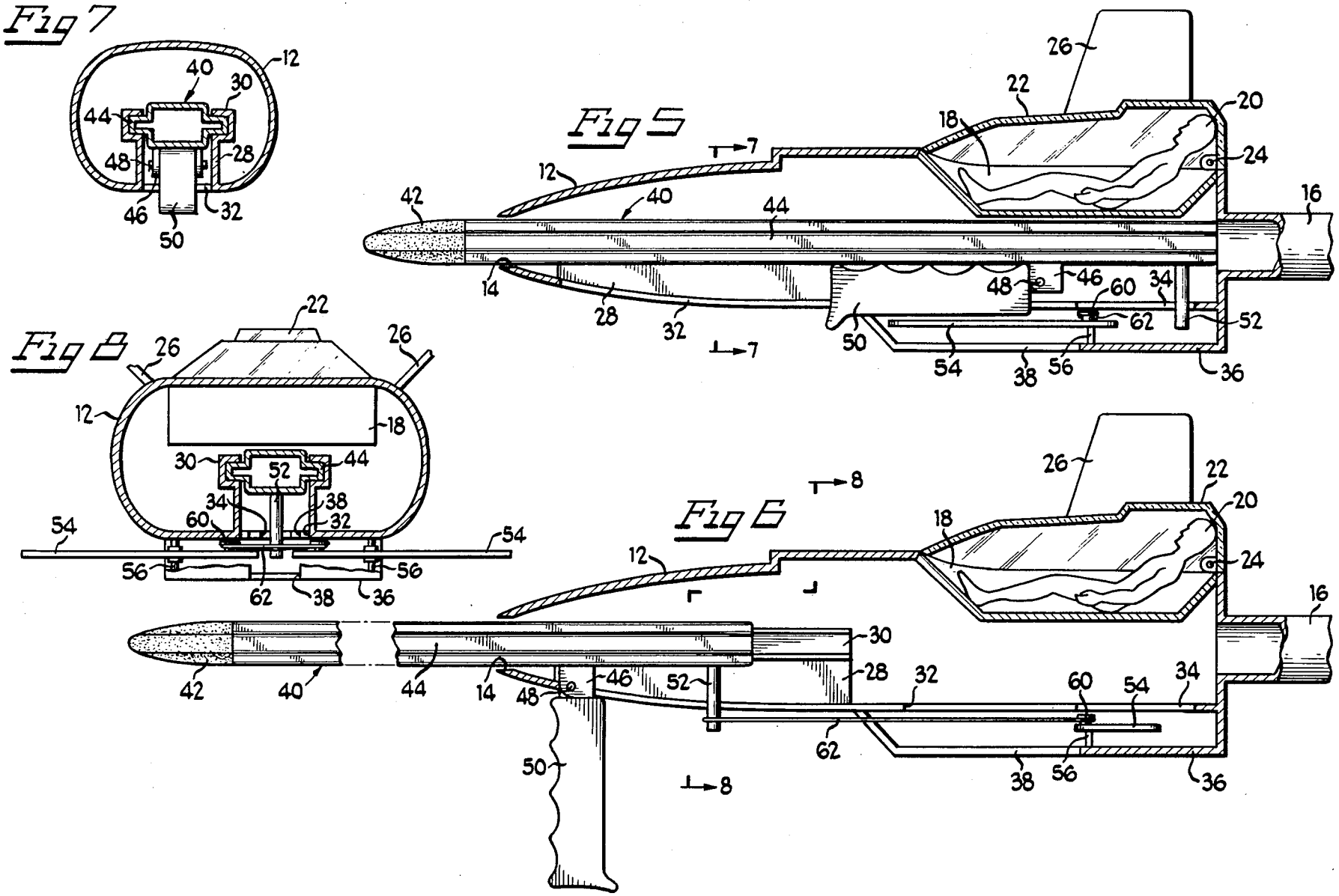
FIG. 5 is an enlarged scale, sectional view taken along line 5—5 of FIG. 1.
FIG. 6 is an enlarged scale, sectional view taken along line 6—6 of FIG. 2.
FIG. 7 is a sectional view taken along line 7—7 of FIG. 5.
FIG. 8 is a sectional view taken along line 8—8 of FIG. 6.

When toy sword spaceship 10 is in the spaceship mode, blade 40 is retracted with substantially only the soft tip 42 extending beyond the truncated open nose 14. Tip 42 thus completes the noseof the toy spaceship. With blade 40 in the retracted position as illustrated in FIGS. 1, 3 and 5, handle 50 is folded forwardly up and stored substantially within body shell 12. The bottom end of handle 50 remains outside of the shell for user accessibility.

Toy sword blade 40 is extended to transform from the spaceship mode to the toy sword mode illustrated in FIGS. 2, 4 and 6. The accessible bottom portion of handle 50 is pushed forwardly and the handle is then folded down about pivot pin 48 to fully extend toy sword blade 40 along tracks 30. As the sword blade is extended, depending post 52 engages elastic band 62 and causes each of wings 54 to pivot outwardly from the open sided compartment formed by shield piece 36. Outwardly pivoted wings 54, together with fixed wing 26, form a hilt for the sword. Handle 50 abuts the forward end of slot 32 to limit extension of blade member 40.

While a particular embodiment of the present invention has been shown and described, changes and modifications will occur to those skilled in the art. It is intended in the following claims to cover all such changes and modifications as fall within the true spirit and scope of the present invention.

What is claimed as new and desired to be secured by Letters Patent is:

1. A toy vehicle transformable into a toy sword comprising:

an elongated generally hollow body shell having an open forward end;

a handle projecting rearwardly from the body shell;

track means within the shell;

an extendable elongated blade member receivable within the shell, the blade member having guide means slidably received in the track means;

the blade member being slidable from a retracted position in which the blade member is substantially contained within the shell to a extended position in which a substantial part of the blade member extends beyond the open, forwrd end of the shell; and another handle pivotally connected at one end to the blade member for movement between a folded down position in which the length of the handle is generally transverse to the length of the blade and a folded up position in which the length of the handle is generally parallel to the length of the blade.

2. The toy of claim 1 in which:

the blade has a tip;

the open forward end of the shell is truncated;

the tip of the blade member is stylistically compatible with the shell; and the tip extends beyond the truncated forward end of the shell when the blade member is retracted.

3. The toy of claim 1 in which the folded up handle is substantially stored within the shell when the blade member is in the retracted position.

4. The toy of claim 3 in which the other end of the folded up handle is accessible to a user when the folded up handle is substantially stored within the shell.

5. The toy of claim 1 including:

a pair of wing members that fold outwardly on opposite sides of the shell; and means carried by the blade member engaging means carried by the wings to pivot the wings outwardly as the blade member is moved from the retracted position to the extended position.

6. The toy of claim 5 including a pair of fixed wings on the shell.

7. A toy vehicle transformable into a toy sword comprising:

an elongated generally hollow body shell having an open forward end;

a handle projecting rearwardly from the body shell;

track means within the shell;

an extendable elongated blade member receivable within the shell, the blade member having guide means slidably received in the track means;

the blade member being slidable from a retracted position in which the blade member is substantially contained within the shell to a extended position in which a substantial part of the blade member extends beyond the open, forward end of the shell;

a pair of wing members that fold outwardly on opposite sides of the shell; and means carried by the blade member engaging means carried by the wings to pivot the wings outwardly as the blade member is moved from the retracted position to the extended position.

8. The toy of claim 7 including a pair of fixed wings on the shell.

9. The toy of claim 7 in which:

the blade has a tip;

the open forward end of the shell is truncated;

the tip of the blade member is stylistically compatible with the shell; and the tip extends beyond the truncated forward end of the shell when the blade member is retracted.

10. The toy of claim 7 including:

another handle pivotally connected at one end to the blade member for movement between a folded down position in which the length of the handle is generally transverse to the length of the blade and a folded up position in which the length of the handle is generally parallel to the length of the blade; and the folded up handle being substantially stored within the shell when the blade member is in the retracted position.

11. The toy of claim 10 in which the other end of the folded up handle is accessible to a user when the folded up handle is substantially stored within the shell.

12. A toy vehicle transformable into a toy sword comprising:

an elongated generally hollow body shell having an open forward end;

a handle projecting rearwardly from the body shell;

track means within the shell;

an extendable elongated blade member receivable within the shell, the blade member having guide means slidably received in the track means;

the blade member being slidable from a retracted position in which the blade member is substantially contained within the shell to a extended position in which a substantial part of the blade member extends beyond the open, forward end of the shell; and the shell including a recessed cockpit for receiving a toy action figure and a pivotally mounted transparent canopy for covering the cockpit.

13. The toy of claim 12 in which:

the blade has a tip;

the open forward end of the shell is truncated;

the tip of the blade member is stylistically compatible with the shell; and the tip extends beyond the truncated forward end of the shell when the blade member is retracted.

14. The toy of claim 12 including another handle pivotally connected at one end to the blade member for movement between a folded down position in which the length of the handle is generally transverse to the length of the blade and a folded up position in which the length of the handle is generally parallel to the length of the blade.

15. The toy of claim 14 in which the folded up handle is substantially stored within the shell when the blade member is in the retracted position.

16. The toy of claim 15 in which the other end of the folded up handle is accessible to a user when the folded up handle is substantially stored within the shell.

17. The toy of claim 12 including:

a pair of wing members that fold outwardly on opposite sides of the shell; and means carried by the blade member engaging means carried by the wings to pivot the wings outwardly as the blade member is moved from the retracted position to the extended position.

18. The toy of claim 17 including a pair of fixed wings on the shell.

* * * * *